US006067816A

United States Patent [19]

Hodosh

[11] Patent Number: 6,067,816

[45] **Date of Patent: *May 30, 2000**

[54] INSULATED SOFT-SIDED PORTABLE CASE HAVING EXTERNALLY ACCESSIBLE RECEPTACLE

[75] Inventor: Marc A. Hodosh, Brookline, Mass.

[73] Assignee: California Innovations Inc., Willowdale, Canada

[ * ] Notice: This patent is subject to a terminal disclaimer.

[21] Appl. No.: 09/264,075

[22] Filed: Mar. 8, 1999

Related U.S. Application Data

[63] Continuation of application No. 09/036,566, Mar. 9, 1998, Pat. No. 5,924,303.

[51] Int. Cl.[7] ..... F25D 3/08

[52] U.S. Cl. ..... 62/457.4; 62/457.7; 62/457.5; 220/592.17

[58] Field of Search ..... 62/457.4, 457.7, 62/457.5, 530, 371, 458, 457.2; 220/592.17, 592.16, 592.01, 903

[56] References Cited

U.S. PATENT DOCUMENTS

| | | | |
|---|---|---|---|
| D. 328,550 | 8/1992 | Mogil | D7/605 |
| D. 382,771 | 8/1997 | Mogil | D7/607 |
| D. 382,772 | 8/1997 | Mogil | D7/607 |
| D. 387,249 | 12/1997 | Mogil | D7/607 |
| D. 389,704 | 1/1998 | Yousko et al. | D7/607 |
| 2,555,788 | 6/1951 | Donaldson | 206/4 |
| 2,610,472 | 9/1952 | Maxwell | 62/2 |
| 2,645,332 | 7/1953 | Martin et al. | 206/4 |
| 3,255,607 | 6/1966 | Bair et al. | 62/372 |
| 3,572,054 | 3/1971 | Curcio | 62/390 |
| 3,998,072 | 12/1976 | Shaw | 62/457 |
| 4,050,264 | 9/1977 | Tanaka | 62/457 |
| 4,286,440 | 9/1981 | Taylor | 62/457 |
| 4,499,998 | 2/1985 | Carlson | 206/541 |
| 4,551,988 | 11/1985 | Petrantom | 62/457 |
| 4,610,286 | 9/1986 | Cyr | 150/52 |
| 4,655,052 | 4/1987 | Garcia | 62/441 |
| 4,673,117 | 6/1987 | Calton | 224/151 |
| 4,706,856 | 11/1987 | Jacober | 224/151 |
| 4,819,793 | 4/1989 | Willard | 206/162 |
| 4,858,444 | 8/1989 | Scott | 62/372 |
| 4,916,923 | 4/1990 | Adams et al. | 62/457.1 |
| 4,923,060 | 5/1990 | Breslau | 206/316.2 |
| 4,941,603 | 7/1990 | Creamer et al. | 224/148 |
| 4,984,662 | 1/1991 | Jacober | 190/107 |
| 5,050,399 | 9/1991 | Peahl | 62/244 |
| 5,095,718 | 3/1992 | Ormond et al. | 62/457.5 |
| 5,313,807 | 5/1994 | Owen | 62/457.3 |
| 5,354,131 | 10/1994 | Mogil | 383/24 |
| 5,400,610 | 3/1995 | Macedo | 62/130 |
| 5,501,338 | 3/1996 | Preston | 206/545 |
| 5,505,307 | 4/1996 | Shink | 206/541 |
| 5,718,124 | 2/1998 | Senecal | 62/457.6 |
| 5,842,571 | 12/1998 | Rausch | 206/549 |
| 5,924,303 | 7/1999 | Hodosh | 62/457.7 |

FOREIGN PATENT DOCUMENTS

| | | |
|---|---|---|
| 2 066 803 | 4/1992 | Canada . |
| 2 025 593 | 1/1980 | United Kingdom . |

*Primary Examiner*—William Doerrler
*Attorney, Agent, or Firm*—Cook, Alex, McFarron, Manzo, Cummings & Mehler, Ltd.

[57] ABSTRACT

A portable insulated case is provided which has insulative properties and which can function as a socalled cooler in order to help maintain a temperature within the container which is lower than room temperature. Such devices can also be used for maintaining a warmed environment. The top panel of the case has at least one receptacle or pocket depending from it and into the container. This receptacle closely holds a can, bottle or the like. The case thus functions as a holder for an open drink can, for example, while also having an externally accessible receptacle which assists in keeping it cool or warm as the case may be.

20 Claims, 2 Drawing Sheets

INSULATED SOFT-SIDED PORTABLE CASE HAVING EXTERNALLY ACCESSIBLE RECEPTACLE

This application is a continuation of application Ser. No. 09/036,566, filed Mar. 9, 1998 now U.S. Pat. No. 5,924,303 issue date Jul. 20, 1999.

DESCRIPTION

Background of the Invention

This invention generally relates to portable insulated cases which are of the soft-sided variety. More particularly, the portable insulated case is especially well suited for temporarily storing containerized drinks as well as foods, particularly those which are most advantageously stored under chilled conditions at a temperature lower than ambient temperature. The top panel of the case has at least one opening therethrough. Each such opening accommodates a downwardly depending receptacle which is accessible from outside of the portable insulated case.

Insulated containers which are easily transportable are well-known and intended for use for a variety of purposes. Included are containers which are designed for temporary storage of food and drink products for use in connection with personal travel, day trips, outings, and other similar activities where a drink or meal supply needs to be kept cool or warm for several hours.

Cases or containers in this regard include soft-walled coolers. In a typical cooler, a low temperature sink is provided, such as by ice cubes or so-called ice bricks positioned within the cooler in order to assist in maintaining a lower temperature within the cooler than is typically present outside of the cooler. Outside or ambient temperatures include room temperature and higher temperatures which can be encountered during summer months, for example. Typically, these types of coolers function solely as a vehicle for storage of drink and food products within the enclosure volume provided within the walls of the cooler. Once the item to be consumed is removed from the inside volume of the cooler, the cooler ceases to have any designed function in connection with the items to be consumed. For example, once the item to be consumed is removed from the container, it is no longer influenced by the cooling function provided by the cooler.

An important recognition attendant to the present invention is that advantages can be gained by creating a situation where the cooler can continue to provide the opportunity for positive interaction between the cooler and a food item such as a containerized drink after it has been removed from the cooler.

SUMMARY OF THE INVENTION

An insulated soft-sided portable case having one or more externally accessible receptacles is provided. A plurality of panels define an insulated enclosure which retards heat transfer and which is adapted to receive cold drinks and foods and cooling sources such as ice cubes, cooling bricks, and the like. A top panel of the portable insulated container has at least one, opening therethrough, and a receptacle is positioned with respect to the opening so that the receptacle is accessible from the outside of the portable insulated case; that is, the user can place an item such as a containerized cold drink within the receptacle without having to open the portable insulated case. This externally accessible receptacle is thus adapted to function as a holder for the containerized drink and the like. It also projects well into the enclosed volume of the container. As such, the portable insulated case functions as a convenient and secure location for holding an opened drink without spilling it, while at the same time keeping a cold containerized drink cool.

In an aspect of the invention there is a portable soft-sided insulated container having an insulated enclosure volume defined therein. It has a closure member openable to permit objects to be placed within the enclosure volume, and an insulated panel. The insulated panel has an opening defined therein. A receptacle is mounted to the panel and to extend inwardly from the panel relative to the insulated enclosure volume. The receptacle is located to permit objects introduced through the opening to seat therein. The receptacle has an open mouth to permit an object seated therein to protrude outwardly through the opening, and the receptacle has a volume that also permits other objects to be placed within the insulated enclosure volume as well.

In an additional feature of that aspect of the invention, the receptacle has a depth by which it extends inwardly of such panel, to permit at least a portion of an object seated therein to be at least partially shaded. In another additional feature of that aspect of the invention, the receptacle has a wall allowing a rate of thermal transfer greater than through said insulated container whereby heat transfer can occur between said enclosure volume and on object seated in said receptacle. In still another additional feature of that aspect of the invention, the receptacle is waterproof. In still another additional feature of that aspect of the invention, the container has more than one opening that has a receptacle located to seat objects introduced therethrough.

In a further additional feature of that aspect of the invention, the panel is a top panel of the container, and the receptacle extends downwardly therefrom. In a still further additional feature of that aspect of the invention, the container includes a closure for covering the mouth of the receptacle when the receptacle is not in use. In still another additional feature of that aspect of the invention, the receptacle has a resilient inside wall. In a yet further additional feature of that aspect of the invention, the container has a top panel and a sidewall panel. The top panel and the sidewall panel meet at a juncture. The closure member extends along the juncture, and, when the closure member is opened, at least a portion of the top panel at least partially detaches from the remainder of the container to permit access to the insulated enclosure.

In another aspect of the invention, there is a portable, soft-sided insulated container comprising a top panel, a bottom panel, and a sidewall panel extending between said top and bottom panels. The top, bottom and sidewall panels co-operate to define an insulated enclosure volume therewithin. A closure member is openable to give access to the insulated enclosure volume. The top panel has an opening defined therein. A receptacle is mounted to the top panel and extends inwardly of the top panel. The receptacle has an open mouth that allows an object having a height greater than the depth of the receptacle to protrude outwardly of the opening. The said receptacle has a volume that also permits other objects to be placed in said insulated enclosure volume as well.

In an additional feature of that aspect of the invention, the receptacle has a receptacle wall to permit at least a portion of an object seated in said receptacle to be at least partially shaded. In another additional feature of that aspect of the invention, the receptacle has a wall allowing a rate of thermal transfer greater than through the panels of said insulated container, whereby heat transfer can occur through the receptacle wall, between the enclosure volume and an object seated in the receptacle. In a further additional feature of that aspect of the invention, the receptacle is waterproof. In a still further additional feature of that aspect of the invention, the top panel has more than the one opening having a receptacle located to seat objects introduced therethrough.

In another additional feature of that aspect of the invention, the receptacle has a round bottom wall and a sidewall extending between the top panel and the bottom wall of the receptacle, whereby the receptacle has a shape for seating a round cylindrical container therein. In another additional feature of that aspect of the invention, the receptacle is waterproof. In still another additional feature of that aspect of the invention, the container includes a closure for covering the mouth of the receptacle when the receptacle is not in use. In still yet another additional feature of that aspect of the invention, the receptacle has an inside wall extending inwardly from the top panel and the inside wall is resilient.

In again another additional feature of that aspect of the invention, the top panel is four sided, the bottom panel has four corresponding sides, and the sidewall panel has four portions each extending between respective corresponding sides of the top and bottom panels, the container is waterproof and the receptacle is waterproof. In a further additional feature of that additional feature of the invention, the closure extends around three of the sides of the top panel such that, when the closure member is opened at least a portion of the top panel at least partially detaches from the remainder of the portable, soft sided container.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 2:
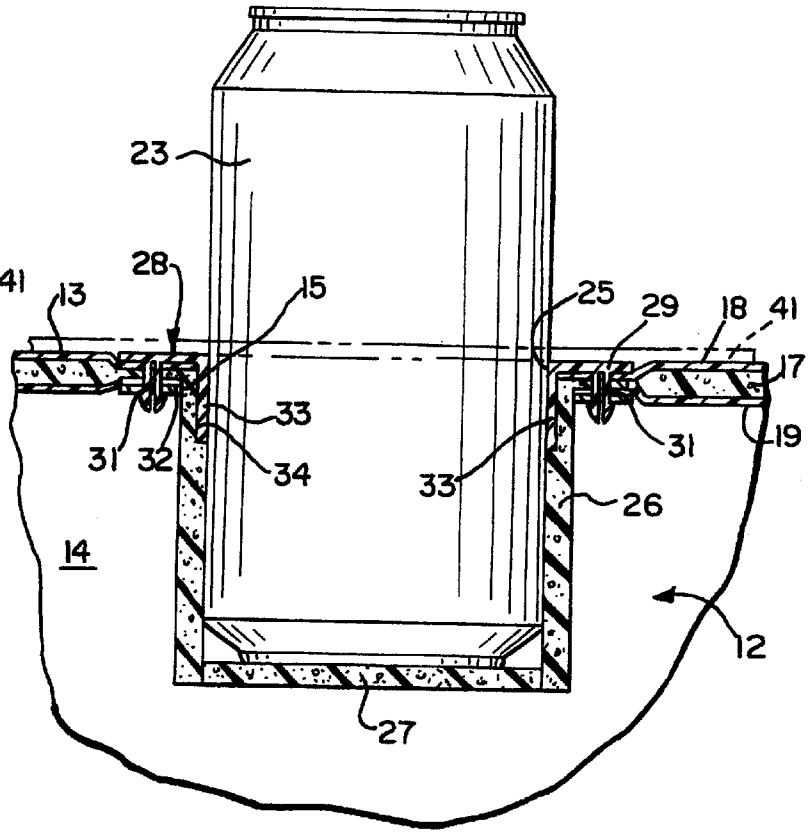
FIG. 2 is a detailed, cut-away generally crosssectional view illustrating an embodiment of the externally accessible receptacle, shown with a can of soda positioned therewithin.

A preferred embodiment of the portable insulated case according to the invention is generally illustrated at 11. Portable insulated case 11 defines an insulated enclosure volume, generally designated at 12. This volume is adequate to accommodate a plurality of food andlor drink items which are held within the closed case.

Case 11 includes atop panel 13, a bottom panel (not shown) and a sidewall panel 14. A typical sidewall panel, such as that illustrated, has four sides in a generally rectangular upstanding arrangement. Other configurations, arrangements or designs can be practiced in order to provide a desired container shaping and sizing. Whatever arrangement of panels is chosen, the insulated case should be water-tight and not leak.

It will be noted that the top panel 13 includes an opening 15 therethrough. The illustrated embodiment also shows a second opening 16. It will be appreciated that three or more openings could also be provided, depending upon the size of the top panel and the intended requirements or selected specifications of the portable insulated case.

Each panel of the portable insulated case 11 has insulative properties in that heat transfer is retarded across the panel. An example of a suitable panel construction in this regard includes an internal core of foam 17. Suitable foam polymers include ethylpropylene ethylene (EPE). A typical core will be about 8 mm thick. External or on opposite sides thereof are a protective and decorative layer of polymer sheeting 18 and another protective and decorative layer of polymer sheeting 19. Layers 18 and 19 preferably are made of a material which is easy to clean. A suitable material in this regard is nylon sheeting. It will be appreciated that other materials and combinations of materials can be suitable.

In order to maintain the soft-sided characteristic of the portable insulated case, it is preferred that at least the sidewall panel 14 be pliable. In a typical case, the top panel 13 or the bottom panel, or both, will also be pliable. When provided, the softwalled nature of the panels renders them more comfortable to handle, more easily fit into tight spaces when required, and generally lighter in weight.

Whatever the exact structure of the portable insulated case, a closure member or assembly, such as the illustrated zipper 21, is positioned with respect to the top panel 13 and the sidewall panel 14 such that the top panel is openable. Other closure members or assemblies are possible, such as snaps, hook-and-loop arrangements, string ties, and the like. The exact location of the selected closure member can vary, provided it allows for selective opening and closing of all or a large portion of the top panel, either alone or together with an upper portion of the sidewall panel. It is typically preferred that at least a portion of the top panel be able to remain attached to the rest of the portable insulated case. For example, in the embodiment illustrated in FIG. 3, the top panel remains attached to the sidewall along a hinge or edge area 22 (FIG. 3).

Figure 3:
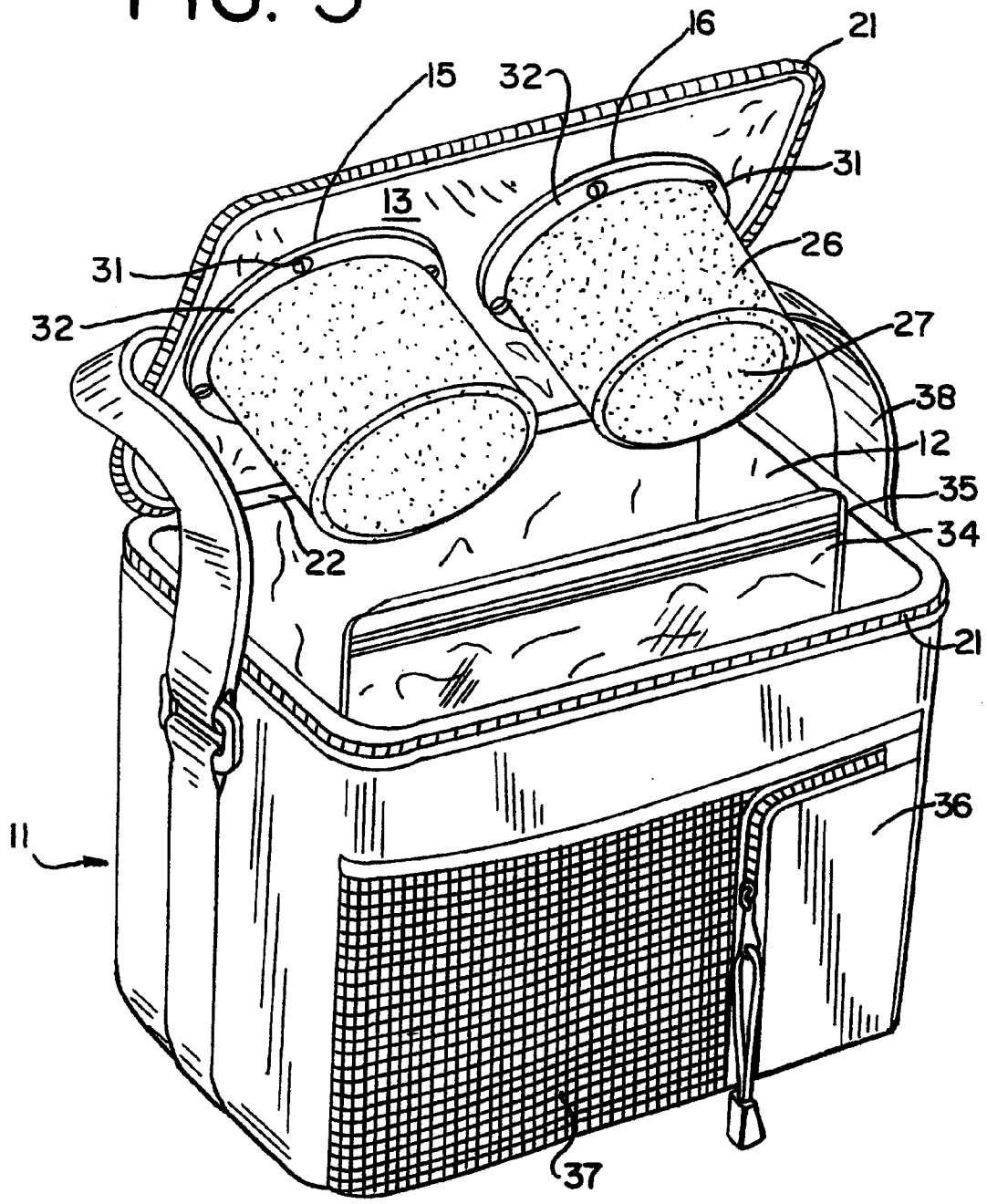
FIG. 3 is a perspective view of the embodiment as generally shown in FIG. 1, with the portable insulated case being shown in an open configuration.

It will be appreciated that, when the portable insulated case 11 is in the open configuration illustrated in FIG. 3, the user has ready access to the insulated enclosure volume 12, thereby allowing items such as filled drink cans 23 and filled drink bottles (glass or plastic) 24 to be placed within and removed from the insulated enclosure volume. In an important aspect of the invention, one or more selected cans 23, bottles 24 or the like can be accessed without having to undo the closure member, open the top, and thereby permit undesirable heat transfer through the resulting open area, whether the transfer be into the insulated case (when it is a cooler) or out of the insulated case (when it functions to keep warm items warm).

Figure 1:
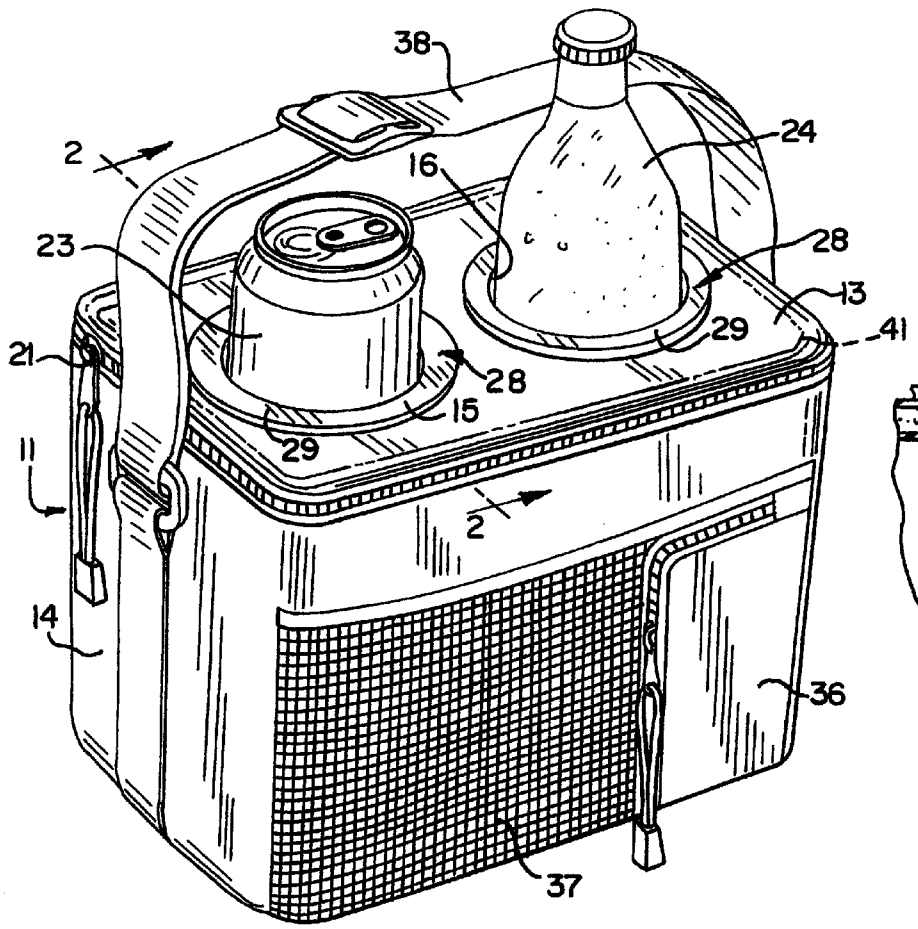
FIG. 1 is a perspective view of a preferred form of the portable insulated case according to the invention.

In accomplishing this objective, at least one externally accessible receptacle is provided. Two such receptacles are illustrated in FIG. 1 and in FIG. 3. In essence, each receptacle is in general alignment with opening 15, 16 in the top panel 13. Each externally accessible receptacle takes a general form desired for the particular end use. These include sleeves, pockets, shaped cylinders and the like. Each such receptacle includes a mouth 25. In the illustrated embodiment, mouth 25 conforms to the shape of the opening 15 and has a perimeter size slightly less than that of the opening 15. Mouth 25 is selected to have a perimeter and size which closely approximates the external perimeter shape and size of the can, bottle or the like to be held. The receptacle provides a downwardly depending structure which accommodates at least a substantial portion of the volume of the can, bottle or the like. Preferably, the height of the receptacle is less than the total height of the can, bottle or the like in order to permit easy digital access to the can, bottle or the like; that is, a user can grasp and easily remove the can, bottle or the like from out of the receptacle when desired, such as in order to drink from or pour from the can, bottle or the like.

The structure of the receptacle which is illustrated in the drawings includes a downwardly depending sidewall 26 which is generally vertically oriented when the portable insulated case is in the upright position as illustrated in the drawings. The illustrated receptacle further includes a bottom wall 27 upon which the can, bottle or the like can rest. In the illustrated form, downwardly depending sidewall 26 has the configuration of a right cylinder, and the bottom wall 27 takes on the shape of a disc. This shaping is particularly well-suited for closely accommodating illustrated can 23 and/or bottle 24.

Preferably, the inner diameter of the downwardly depending sidewall 26 approximates that of a typical can 23 or bottle 24, or both. It is especially preferred that at least the downwardly depending sidewall 26 be made of a pliable and somewhat resilient material. In that instance, the inside diameter of the sidewall 26 can be slightly greater than the outside diameter of the container 23, 24 so that the container will slightly compress the sidewall so as to enhance the gripping security imparted by the receptacle onto the container. A material found to be suitable in this regard is poly (2-chloro-1,3-butadiene), also known as polychloroprene or neoprene. Other synthetic rubber materials or pliable and resilient polymers can be used, for example. For convenience, the bottom wall 27 can be made of the same material as the downwardly depending sidewall 26. Preferably, the material of the receptacle is a waterproof material.

The receptacle is to be integral with the top panel 13 at its opening 15, 16. Single-piece construction is possible in this regard, although often an assembly can be somewhat more convenient, particularly when the receptacle material is different from that of the top panel 13. As an example, a flange member 28 can be used to join the receptacle to the top panel. Illustrated flange member 28 includes a horizontal plate 29 which overlies the opening 15, 16 and the adjacent edge of the top panel 13. A plurality of fastening devices such as the illustrated flexing fasteners 31 project from the horizontal plate 29 and into and through the top panel 13. Another horizontal plate 32 can also be included in order to enhance the security of the connection between the fastening devices and the top panel. In this regard, the fastening devices pass through respective openings provided in the separate horizontal plate 32. The illustrated flexing fasteners 31 snap into place thereat.

Illustrated flange member 28 also includes a vertical plate 33 which downwardly depends from the horizontal plate 29. A cut-out or indent 34 can be provided in the receptacle sidewall 26 in order to accommodate the thickness and height of the vertical plate 33. Alternatively, any inherent flexibility of the receptacle material can permit compression of that material which is under the vertical plate 33. By either approach, as illustrated, the exposed surface of the vertical plate is flush with the inside surface of the receptacle sidewall, or the vertical plate is slightly indented with respect to the receptacle. It will be appreciated that the surface of the receptacle typically will thus engage the container 23, 24 when same is present within the receptacle.

Typically, the insulated enclosure 12 of the case will also contain a cooling source which is at a temperature below room temperature and which is typically below the freezing point of water. Ice or commercially available freezing packs are suitable. FIG. 3 illustrates the use of a heavy duty pouch having easy openable and closeable means, such as mating profile strips 35. Refrigerator ice or the like can be inserted into the pouch in order to contain, for example, ice as it melts into water.

It will be noted that the receptacles downwardly depend into the insulated enclosure 12 and thus (when the insulated case is a cooler) within the cool environment of the insulated enclosure which is caused by items within the enclosure. Such items include the cooling member which is typically included therewithin, for example the illustrated heavy duty pouch 34 containing ice cubes or the like. Also often contributing to this cool environment within the insulated enclosure 12 are the drink or food items enclosed therewithin. Because the receptacles are within this environment, they can be positively affected by the environment of the insulated enclosure.

More specifically, depending upon the material out of which the receptacles are made, for example the material of the downwardly depending sidewall 26 and bottom wall 27, a certain degree of heat transfer can occur across the walls of the receptacle. When this feature is provided, a can of soda, for example, which is well below room temperature when within the insulated enclosure 12 will still be subjected to the cooling environment of the insulated enclosure even after same is outside of the insulated enclosure volume and is placed within one of the receptacles, as seen in FIG. 1 and FIG. 2. When this feature is provided, the walls of the receptacle, such as the illustrated downwardly depending sidewall 26 or the bottom wall 27, or both, allow a greater degree of heat transfer through them than is allowed by the panels of the portable insulated case 11. It will be appreciated that, under this circumstance, the rate of thermal transfer through the receptacle walls will be faster than through the case panels.

When a can, bottle or the like is positioned within a receptacle, such as is illustrated in FIG. 1 and FIG. 2, there occurs a reduction of heat transfer out of the can, bottle or the like and into the surrounding atmosphere which is typically at a temperature higher than that of the can, bottle or the like. Maintaining a cool item cool also is achieved in part because a substantial portion of the can, bottle or the like is shaded from the sun or other heat generating sources by virtue of its being enclosed within the receptacle. In addition, the receptacle itself has an insulative effect on the portion of the can, bottle or the like which is enclosed within the receptacle. Such insulating effects occur irrespective of any cooling effect imparted through the receptacle wall by virtue of the cool environment of the insulated enclosure 12.

All of the features described above provide a beneficial effect. Each contributes to the advantage of the invention of assisting in keeping the can, bottle or the like cool while same is securely held within one of the receptacles according to the invention. Overall, therefore, the invention provides advantageous security in preventing spillage of an open drink, for example, while simultaneously assisting in keeping the drink cool for a longer period of time than is achieved by approaches that do not combine a holding function with a cooling function within the same compact, convenient and portable device.

The illustrated portable insulated case includes a zippered security pocket 36 which is provided for convenient storage of smaller items such as keys, money, wallets, watches, personal items and the like. It will be appreciated that the illustrated zipper can be substituted for by using other closure arrangements. Also illustrated is an outside mesh pocket 37, which can be suitable for storing other items such as glasses, books, lotions and the like. The bottom panel (not shown) of the portable insulated case 11 is preferably made of a non-skid, durable and water-resistant material, or has an outer layer composed of material having these types of properties. An adjustable carrying strap 38 can be included as shown.

While the illustrations of the invention which are specifically shown herein indicate a fully open mouth 25 for each of the receptacles, it will be appreciated that temporary covers or closures can be included. For example, when it is desired to allow for closure of each receptacle mouth 25 when a can or the like is not within the receptacle, a sheet of material (or other structure) can be positioned for temporary full closure or partial closure of one (or of each) receptacle mouth. A top cover panel 41 is shown in phantom in FIG. 1 and in FIG. 2. A panel of this type can be provided. This allows the user to cover each receptacle mouth until it is desired to use the receptacle for holding and maintaining coolness (or warmness) of the can, bottle or the like by positioning same into the receptacle. Such a top cover panel can be temporarily secured to the outside of the insulated case by any suitable connection means, such as zipper, hook-and-loop components, snaps, tabs, tie strings and the like (not shown).

A total of two receptacles are shown in FIG. 1 and FIG. 3. Other possible variations provide a single receptacle, which would be particularly suitable for use by a single person. Larger portable insulated cases can include a greater number of receptacles in order thereby to accommodate a greater number of users. Correspondingly, the portable insulated case itself typically is larger in volume when there are a greater number of receptacles. In an illustrated arrangement, a single-receptacle portable insulated case will accommodate from four to six 12-ounce cans, a dual receptacle portable insulated case will accommodate about twelve such cans, and a triple-receptacle portable insulated case will accommodate twenty-four such cans.

It will be understood that the embodiments of the present invention which have been described are illustrative of some of the applications of the principles of the present invention. Various modifications may be made by those skilled in-the art without departing from the true spirit and scope of the invention.

What is claimed is:

1. A portable soft-sided insulated container having an insulated enclosure volume defined therein, a closure member openable to permit objects to be placed within said enclosure volume, and an insulated panel; said insulated panel having an opening defined therein, and a receptacle mounted to said panel to extend inwardly from said panel relative to said insulated enclosure volume; said receptacle being located to permit objects introduced through said opening to seat therein; said receptacle having an open mouth to permit an object seated therein to protrude outwardly through said opening; and said receptacle having a volume that also permits other objects to be placed within said insulated enclosure volume.

2. The portable soft-sided insulated container of claim 1 wherein such receptacle has a depth by which it extends inwardly of said panel, to permit at least a portion of an object seated therein to be at least partially shaded.

3. The portable soft-sided insulated container of claim 1 wherein such receptacle has a wall allowing a rate of thermal transfer greater than through said insulated container whereby heat transfer can occur between said enclosure volume and on object seated in said receptacle.

4. The portable, soft-sided insulated container of claim 1 wherein said receptacle is waterproof.

5. The portable, soft-sided insulated container of claim 1 wherein said container has more than one said opening, and more than one of said openings has a receptacle located to seat objects introduced therethrough.

6. The portable, soft-sided insulated container of claim 1 wherein said panel is a top panel of said container, and said receptacle extends downwardly therefrom.

7. The portable, soft-sided insulated container of claim 1 wherein said container includes a closure for covering said mouth of said receptacle when said receptacle is not in use.

8. The portable, soft-sided insulated container of claim 1 wherein said receptacle has a resilient inside wall.

9. The portable, soft-sided insulated container of claim 1 wherein said container has a top panel and a sidewall panel; said top panel and said sidewall panel meet at a juncture and said closure member extends along said juncture; and, when said closure member is opened, at least a portion of said top panel at least partially detaches from the remainder of said container to permit access to said insulated enclosure.

10. A portable, soft-sided insulated container comprising a top panel, a bottom panel, and a sidewall panel extending between said top and bottom panels, said top, bottom and sidewall panels co-operating to define an insulated enclosure volume therewithin; a closure member openable to give access to said insulated enclosure volume; said top panel having an opening defined therein, a receptacle mounted to said top panel and extending inwardly of said top panel, said open mouth allowing an object having a height greater than the said depth to protrude outwardly of said opening; and said receptacle having a volume that also permits other objects to be placed in said insulated enclosure volume.

11. The portable, soft-sided container of claim 10 wherein said receptacle has a receptacle wall to permit at least a portion of an object seated in said receptacle to be at least partially shaded.

12. The portable, soft-sided container of claim 10 wherein said receptacle has a wall allowing a rate of thermal transfer greater than through said panels of said insulated container whereby heat transfer can occur between said enclosure volume and an object seated in said receptacle through said receptacle wall.

13. The portable, soft-sided container of claim 10 wherein said receptacle is waterproof.

14. The portable container of claim 10 wherein said top panel has more than one said opening, and more than one of said openings having a receptacle located to seat objects introduced therethrough.

15. The portable, soft-sided container of claim 10 wherein said receptacle has a round bottom wall and a sidewall extending between said top panel and said bottom wall of said receptacle, whereby said receptacle has a shape for seating a round cylindrical container therein.

16. The portable, soft-sided container of claim 15 wherein said receptacle is waterproof.

17. The portable, soft-sided container of claim 15 wherein said container includes a closure for covering said mouth of said receptacle when said receptacle is not in use.

18. The portable, soft-sided container of claim 10 wherein said receptacle has an inside wall extending, inwardly for said top panel and said inside wall is resilient.

19. The portable, soft-sided container of claim 10 wherein said top panel is four sided, said bottom panel has four corresponding sides, said sidewall panel has four portions each extending between respective corresponding sides of said top and bottom panels, said container is waterproof, and said receptacle is waterproof.

20. The portable, soft-sided container of claim 19 wherein said closure extends around three of the sides of said top panel such that, when said closure member is opened at least a portion of said top panel at least partially detaches from the remainder of the portable, soft sided container.

* * * * *

UNITED STATES PATENT AND TRADEMARK OFFICE
CERTIFICATE OF CORRECTION

PATENT NO : 6,067,816

DATED : May 30, 2000

INVENTOR(S) : Marc A. Hodosh

It is certified that error appears in the above-identified patent and that said Letters Patent are hereby corrected as shown below:

On the Cover Page, under "References Cited, Foreign Patent Documents", Pat. No. "2 025 593" should read --2 025 593A--; in the Abstract, line 2, "socalled" should read --so-called--.

Col. 2, line 26, "on object" should read --an object--.

Col. 3, line 43, "crosssectional" should read --cross-sectional--; line 58, delete "andlor drink items" and insert --or drink items, or both--; line 60, "atop" should read --a top--.

Col. 7, line 45, "in-the" should read --in the--.

Col. 8, line 64, "extending, inwardly" should read --extending inwardly--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,067,816
DATED : May 30, 2000
INVENTOR(S) : Marc A. Hodosh

It is certified that error appears in the above-identified patent and that said Letters Patent is hereby corrected as shown below:

Column 8,
Line 32, after "of said top panel:," insert -- to define a depth of said receptacle, said receptacle having an open mouth. --

Signed and Sealed this

Eighth Day of April, 2003

JAMES E. ROGAN
*Director of the United States Patent and Trademark Office*